US005189928A

United States Patent [19]

Ontrop et al.

[11] Patent Number: 5,189,928

[45] Date of Patent: Mar. 2, 1993

[54] ADJUSTABLE STROKE PUNCH PRESS

[75] Inventors: Patrick H. Ontrop; Robert L. Schockman, both of St. Henry; Frederick C. Bergman, Coldwater, all of Ohio

[73] Assignee: The Minster Machine Company, Minster, Ohio

[21] Appl. No.: 826,792

[22] Filed: Jan. 28, 1992

Related U.S. Application Data

[62] Division of Ser. No. 606,489, Oct. 31, 1990, Pat. No. 5,109,766.

[51] Int. Cl.[5] ..... B30B 5/00; B30B 1/06

[52] U.S. Cl. ..... 74/603; 74/600; 74/571 M; 74/571 R; 74/571 L; 100/257; 100/282

[58] Field of Search ..... 74/600, 836, 44, 117, 74/603, 571 M, 832, 833, 571 R, 571 L, 595, 597, 605; 100/257, 282, 291, 292; 83/530, 628; 72/446

[56] References Cited

U.S. PATENT DOCUMENTS

| | | | |
|---|---|---|---|
| 1,998,242 | 4/1935 | Klocke | 74/571 |
| 2,348,958 | 5/1944 | Celio | 74/571 M |
| 2,454,881 | 11/1948 | Michelman | 74/571 |
| 3,033,055 | 5/1962 | Hahnel | 74/571 |
| 3,765,266 | 10/1973 | Portmann | 74/571 M |
| 3,857,345 | 12/1974 | Higgins | 74/571 M |
| 3,871,311 | 3/1975 | Ciecior et al. | 74/571 M |
| 4,031,778 | 6/1977 | Fazekas | 74/600 |
| 4,044,630 | 8/1977 | Adams | 74/600 |
| 4,156,387 | 5/1979 | Portmann | 100/257 |
| 4,160,409 | 7/1979 | Portmann | 100/257 |
| 4,216,681 | 8/1980 | Morisawa et al. | 74/571 M |
| 4,354,411 | 10/1982 | Griese et al. | 83/862 |
| 4,387,566 | 6/1983 | Berchowitz | 74/571 M X |
| 4,538,336 | 9/1985 | Oliver | 74/571 M |
| 4,748,883 | 6/1988 | Portmann | 83/530 |
| 4,785,732 | 11/1988 | Czapka et al. | 100/257 |
| 4,846,014 | 7/1989 | Shiga et al. | 74/595 |
| 4,858,815 | 8/1989 | Roberts et al. | 74/571 M |
| 4,955,254 | 9/1990 | Kato | 74/603 |
| 5,105,684 | 4/1992 | Imanishi | 74/600 |
| 5,109,766 | 5/1992 | Ontrop et al. | 100/257 |

FOREIGN PATENT DOCUMENTS

| | | | |
|---|---|---|---|
| 8127545 | 4/1983 | Fed. Rep. of Germany | 74/603 |
| 3345479A1 | 6/1985 | Fed. Rep. of Germany | 100/257 |
| 2740382 | 1/1987 | Fed. Rep. of Germany | 74/603 |
| 8407274 | 8/1990 | Fed. Rep. of Germany | 74/603 |
| 5992200(A) | 11/1982 | Japan | 100/257 |

*Primary Examiner*—Vinh T. Luong
*Attorney, Agent, or Firm*—Baker & Daniels

[57] ABSTRACT

A process for stroke adjustment employs an adjustable stroke punch press which has a crankshaft with an integral eccentric portion around which is disposed an eccentric sleeve, a connection arm, an L-shaped piston-like sleeve, a locking plate, and a clamping plate. During press operation, the eccentric sleeve is locked to the crankshaft through the locking plate and the clamping plate. Stroke length is adjusted by changing the eccentricity of the integral crankshaft eccentric portion relative to the eccentric sleeve. The eccentric sleeve is unlocked from the crankshaft and locked to the connection arm during stroke adjustment allowing the crankshaft to rotate relative thereto by utilizing the inching mode of the press.

4 Claims, 3 Drawing Sheets

ADJUSTABLE STROKE PUNCH PRESS

This is a division of application Ser. No. 07/606,489, filed Oct. 31, 1990 now U.S. Pat. No. 5,109,766 issued on May 5, 1992.

BACKGROUND OF THE INVENTION

The present invention relates to a punch press and more particularly to a variable stroke punch press in which the eccentricity of the drive, and therefore the length of the stroke, is adjusted by rotation of the crankshaft relative to the eccentric sleeve.

The stroke of a crankshaft, and therefore the displacement of the slide member, is defined as the distance the crankshaft moves between its top dead center and bottom dead center positions. This distance determines the maximum depth of drawing when the press is used to implement a drawing process, the maximum height available for a container edge turning process, and the maximum length of the article produced by an ironing or a backward extrusion process, for example.

The stroke length of the press is determined by the application, so a variety of applications require different stroke lengths. Many presses are designed having only one stroke length and are therefore not suited for different applications without substantially repositioning the tooling. In order to perform different applications utilizing only one press, it is known to provide a mechanism to change the stroke length by varying the eccentricity. As shown in U.S. Pat. No. 2,454,881 issued Nov. 30, 1948 to Michelman, a change in stroke length is accomplished by rotating the eccentric relative to the stopped crankshaft. The disadvantage is that the eccentric is buried within the crown of the press, surrounded by the housing and obscured by connection arms, hoses, belts, etc., whereby it is extremely difficult to reach and move the eccentric.

As shown in U.S. Pat. No. 4,785,732 issued Nov. 22, 1988, to Czapka et al., a change in stroke length is accomplished by fixing the eccentric with a bolt supported in the machine frame and rotating the crankshaft relative to the eccentric. Such mechanisms to fix the eccentric to the press frame are often complicated and unwieldy.

It is therefore desirable to provide a variable stroke punch press which overcomes the above disadvantages such that it would be simple to change the stroke length as well as easy to construct and maintain.

SUMMARY OF THE INVENTION

The present invention provides a process for utilizing a punch press designed to satisfy the aforementioned needs by providing a variable stroke punch press in which the eccentric sleeve is fixed to the connection arm while the crankshaft is rotated, relative to the eccentric sleeve to change the effective eccentricity.

A simple connection arm locking mechanism is advantageous over the frame locking mechanism due to the overall design of press punches. With this design the stroke length of the press can be changed without the use of any external members connected to the press structure. In addition, the normal inching mode of the press is used to rotate the crankshaft relative to the fixed eccentric. Since the inching mode utilizes the same power to rotate the crankshaft during operation, no auxiliary mechanism or external forces are needed to change the eccentricity and therefore the stroke length, other than the normal press drive.

A press punch is provided with a variable stroke change mechanism which, during the stroke length change process, under hydraulic action, fixes the eccentric to the connection arm through a locking plate fastened to the eccentric while the crankshaft is rotated in the inching mode to the desired angle. Oil pressure in an oil cavity defined between a base plate and a piston-like sleeve radially mounted on the crankshaft, creates a horizontal force against the piston-like sleeve, and urges against the eccentric sleeve and locking plate to fix the eccentric to the crankshaft. When the pressure is relieved, the eccentric sleeve is unlocked from the crankshaft, allowing movement relative thereto.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENT

Figure 1:
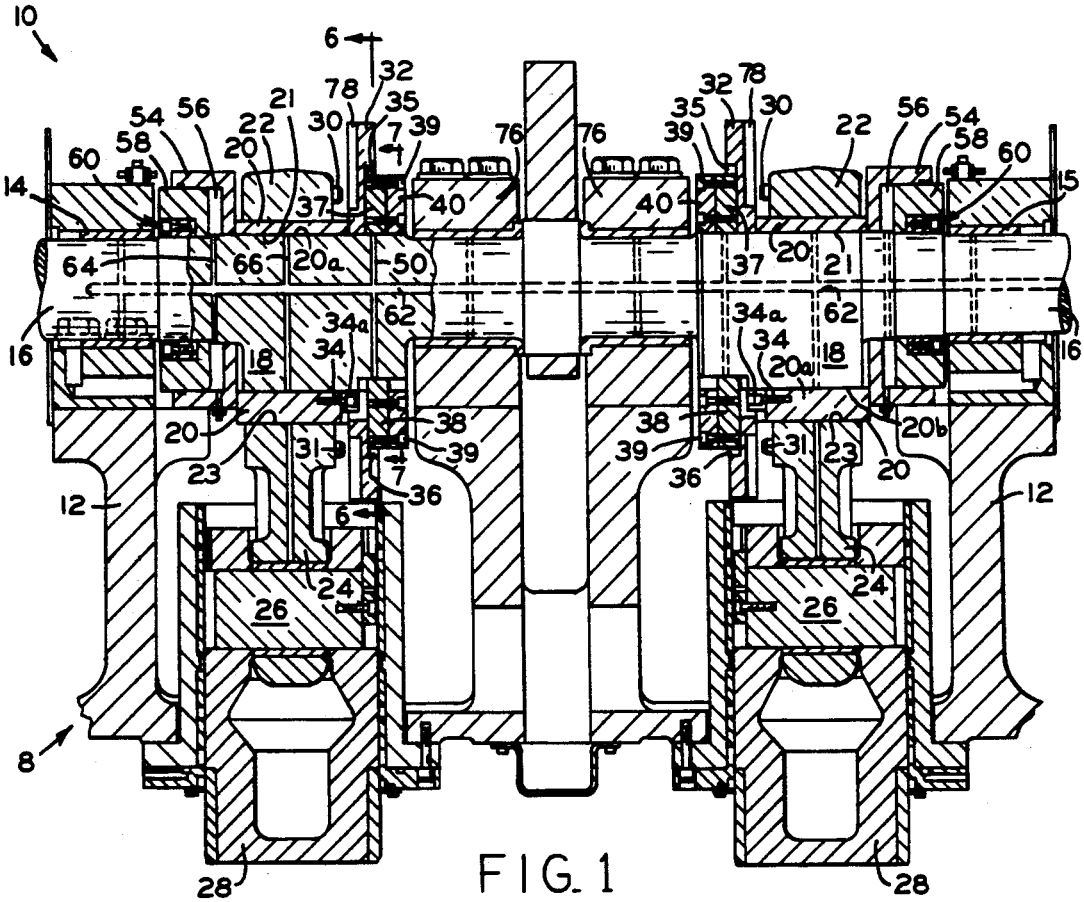
FIG. 1 is a front sectional view of the variable stroke punch press mechanism in the locked or operating mode taken along view line 3—3 of FIG. 4.
Figure 2:
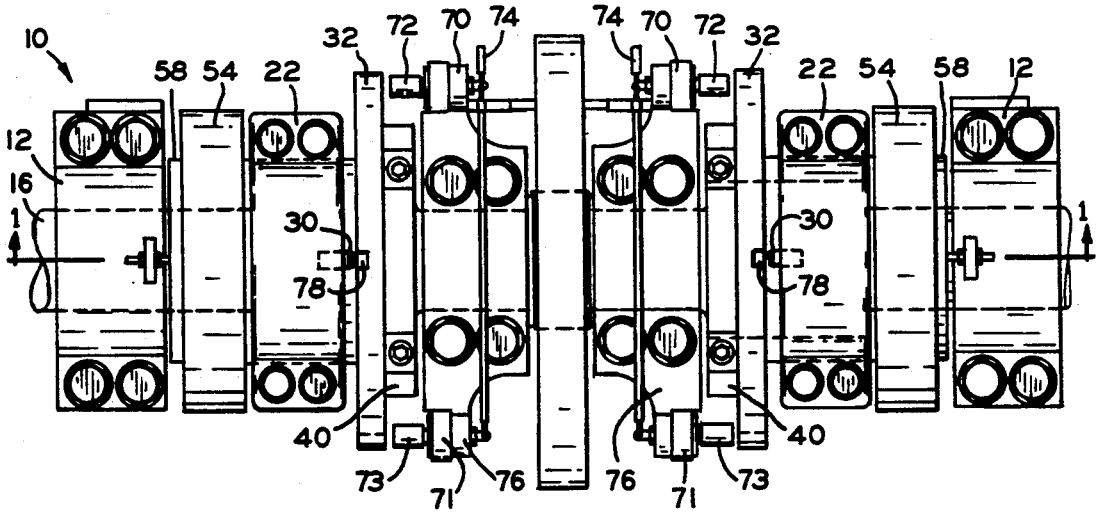
FIG. 2 is a plan view thereof.

Referring to FIGS. 1 and 2, there is shown the upper half of a punch press 8 and, more particularly, an embodiment of the variable stroke press mechanism 10. It is to be noted that the left and right halves of FIGS. 1 and 2 are mirror images of each other, therefore the same descriptions and reference numbers apply to both sides. Variable stroke press mechanism 10 includes a frame 12 having bushings 14 and 15 on either end rotatably supporting a crankshaft 16 having eccentric portions 18 thereon. Radially disposed on each eccentric portion 18 is an eccentric sleeve 20 which is limitedly moveable in the axial direction along crankshaft 16 and has an outer surface **20*a* that is eccentric to its inner surface 20*b*. Eccentric sleeve 20 has oil grooving (not shown) on its bore 21, and is preferably made of brass, although any suitable material may be utilized. Radially disposed on eccentric sleeve 20 is the bore 23 of a connection arm 22 which is fixedly connected through connection arm shank portion 24 and wrist pin 26 to connection slide 28. Protruding axially inward on connection arm 22 are locking pins 30 and 31**.

Figure 6:
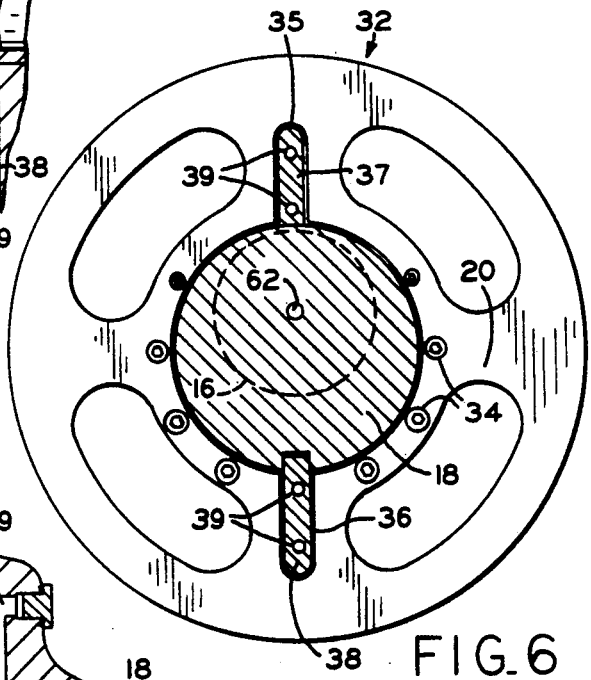
FIG. 6 is a sectional view of the locking plate taken along line 6—6 of FIG. 1.

Axially inward of eccentric sleeve 20 and radially disposed on crankshaft 16 is a locking plate 32 which is fixedly connected to eccentric sleeve 20 by screws 34 and key 34*a*. Other suitable methods of connecting the locking plate 32 to the eccentric sleeve 20 may be utilized as known in the art. Locking plate 32 is also axially moveable on crankshaft 16 since it is fixedly connected by screws 34 to eccentric sleeve 20. Thus, if either component moves, the other must move also. Referring to FIG. 6 there is shown locking plate 32 fixedly connected to eccentric sleeve 20 by an arcuate pattern of screws 34. Locking plate 32 has two elongated recesses 35 and 36 for receiving and engaging clamping plate keys 37 and 38 which are attached to clamping plate 40 by screws 39.

Figure 7:
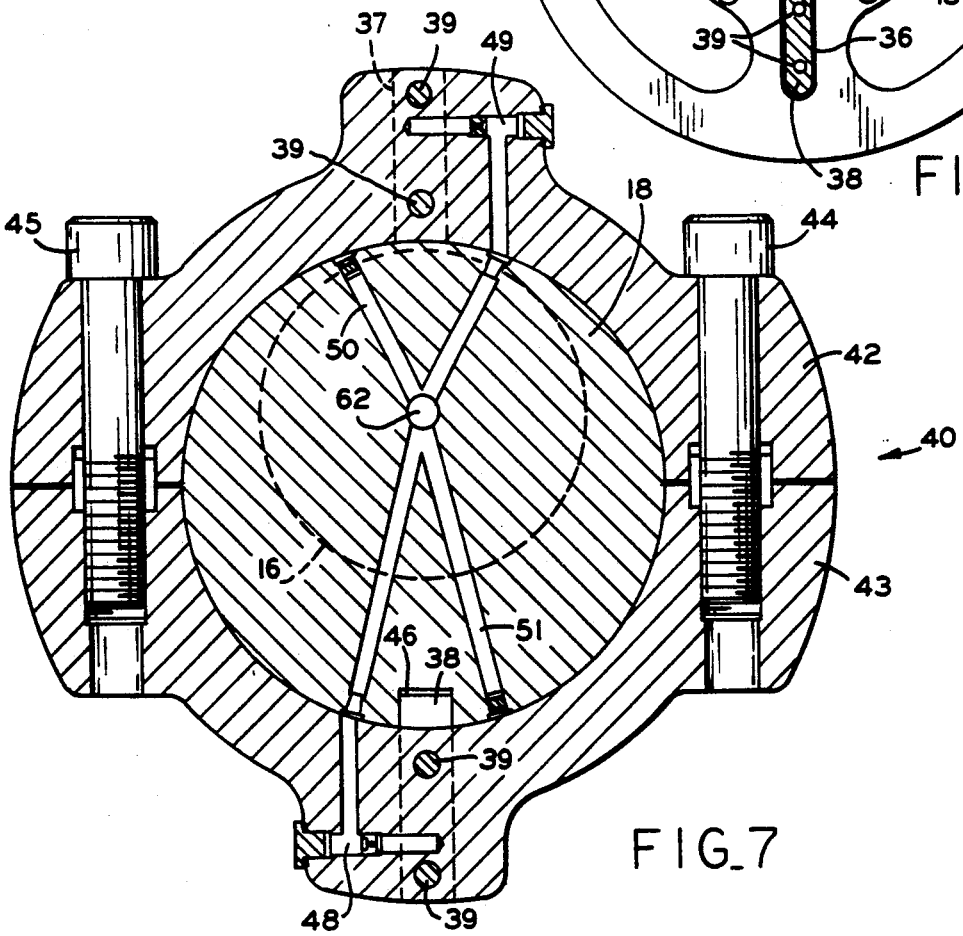
FIG. 7 is a sectional view of the clamping plate taken along line 7—7 of FIG. 1.

As shown in FIG. 7, clamping plate 40 is radially disposed and fixedly mounted on crankshaft 16 and is axially inward of locking plate 32 (FIG. 1). Referring to FIG. 7, clamping plate 40 is shown consisting of an upper half 42 and a lower half 43 fixedly joined by clamping plate bolts 44 and 45 which also help fix clamping plate 40 to crankshaft 16. Clamping plate 40 is also keyed to locking plate 32 by clamping plate keys 37 and 38 fixedly held to clamping plate 40 by screws 39. Key 38 extends into a recess 46 in crankshaft 16 for fixedly mounting clamping plate 40 thereto. Keys 37 and 38 are supplied with pressurized oil through clamping plate oil passages 48 and 49 (FIG. 7) by radial crankshaft oil passages 50 and 51 in communication with axial crankshaft oil passage 62. Fretting can occur between locking plate 32 and keys 37 and 38. By supplying oil to the clamping plate keys 37 and 38, a squeeze film of oil is developed which significantly reduces fretting.

Figure 5:
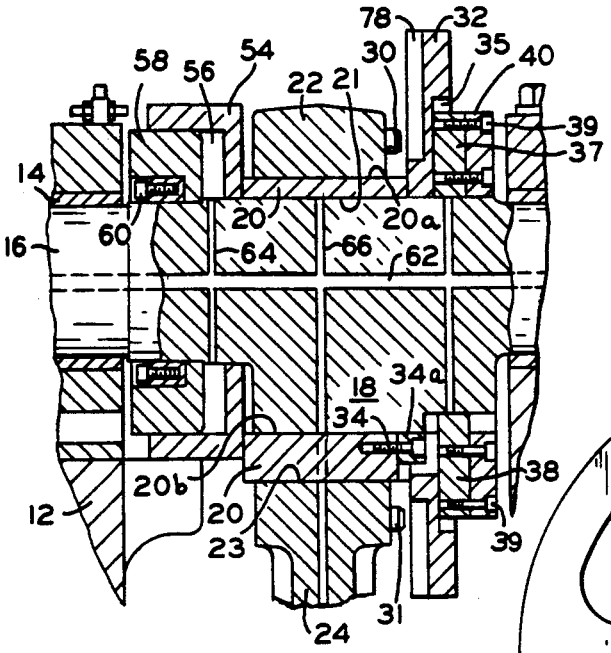
FIG. 5 is an enlarged, fragmentary front sectional view of the punch press variable stroke mechanism in the unlocked or operating mode with the crankshaft eccentric rotated 180° from its top dead center position.

Also radially disposed on crankshaft 16, axially outward of eccentric sleeve 20, is a piston-like sleeve 54 (FIG. 5) which axially moves on crankshaft 16 in response to the intake and discharge of pressurized oil in oil cavity 56 formed by and between sleeve 54 and a base plate 58 radially disposed on crankshaft 16 axially outward of sleeve 54. Base plate 58 is fixedly mounted on crankshaft 16 by wedge-type frictional locking device 60.

In order to supply pressurized oil to oil cavity 56, crankshaft 16 has an axial oil passage 62 communicating with a first radial oil passage 64. During normal press operation, oil cavity 56 is filled with pressurized oil which creates an axially inward force urging piston-like sleeve 54 against eccentric sleeve 20, thereby shifting eccentric sleeve 20 axially inward. Since eccentric sleeve 20 is fixedly connected to locking plate 32, locking plate 32 likewise moves axially inward to lockingly engage clamping plate 40 which is fixedly connected to crankshaft 16. The force present between these plates, not only prevents the locking plate 32 from disengaging with locking keys 37 and 38, it also creates sufficient frictional force between the plates to transmit the required press drive torque. If the press is overloaded and an excessive drive torque is required, the amount of torque which is in excess of that which can be transmitted via the frictional contact between locking plate 32 and clamping plate 40 will be conveyed through locking keys 37 and 38.

A second radial oil passage 66, communicating with axial oil passage 62, supplies pressurized oil to the grooves on the inner diameter of eccentric sleeve 20, forming a squeeze film condition between the eccentric sleeve 20 and the crankshaft 16.

Specifically referring to FIG. 2 showing a plan view of the variable stroke punching press mechanism 10, hydraulic cylinders 70 and 71 with pushers 72 and 73, are fixedly mounted radially outward on center bearing 76 which positions them axially inward of locking plate 32. They are supplied with hydraulic fluid via hydraulic line 74. The hydraulic cylinders and pushers are utilized to disengage locking plate 32 from clamping plate 40 during the stroke change process.

What will now be described is the process utilized to change the stroke length by changing the eccentricity of the punch press. Referring to FIGS. 1 and 2, the variable stroke punch press mechanism 10 is shown during operation. Oil cavity 56 is filled with pressurized oil supplied through first radial oil passage 64 communicating with axial oil passage 62. Since base plate 58 is fixedly mounted to crankshaft 16, the resulting axial force is transmitted to sleeve 54 which is displaced axially inward, thereby axially forcing locking plate 32 into engagement with clamping plate 40 fixedly mounted to crankshaft 16. Locking keys 37 and 38 engage locking plate recesses 35 and 36 stopping the axial movement and securely holding locking plate 32 and eccentric sleeve 20 in position. Pushers 72 and 73 are retracted and do not contact locking plate 32.

Figure 3:
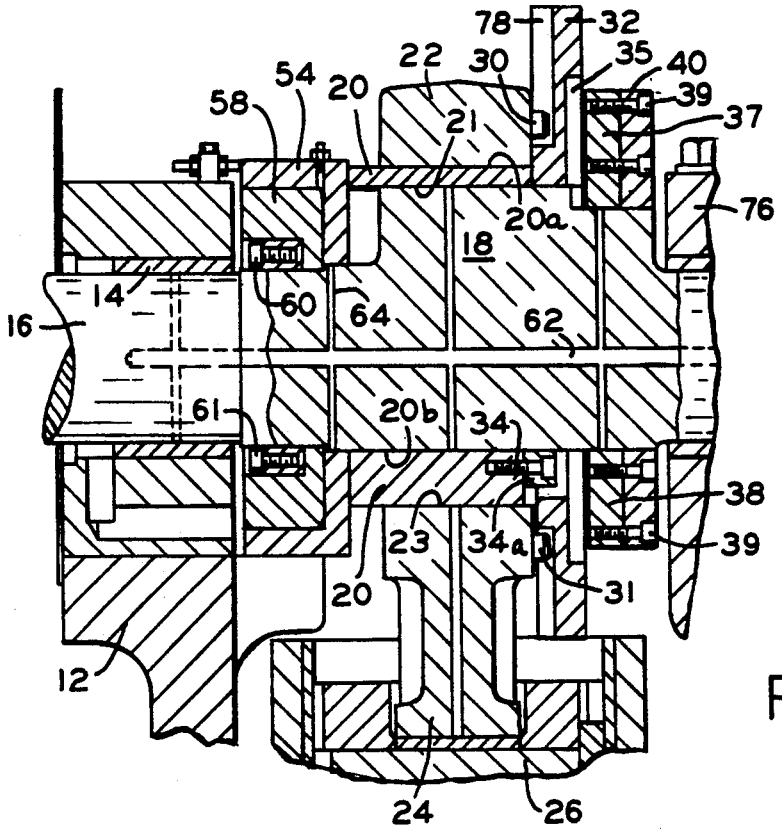
FIG. 3 is an enlarged, fragmentary front sectional view of the variable stroke punch press mechanism in the unlocked or disengaged mode with the crankshaft eccentric in its top dead center position taken along view lines 3—3 of FIG. 4.
Figure 4:
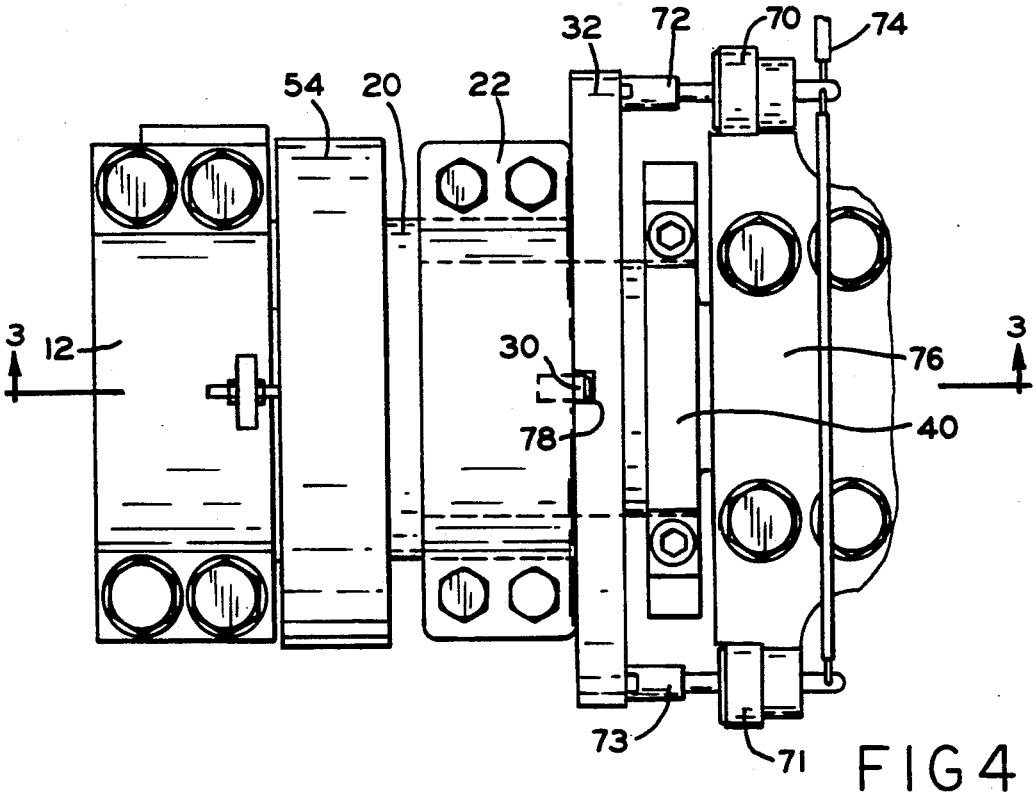
FIG. 4 is a fragmentary plan view thereof.

When the stroke length is to be changed, the pressurized oil is relieved, depleting the oil from oil cavity 56, thus eliminating the pressure between sleeve 54 and base plate 58. Referring to FIGS. 3 and 4, hydraulic cylinders 70 and 71 are energized through hydraulic line 74 which extend pushers 72 and 73 axially outward engaging locking plate 32. Pushers 72 and 73 axially move locking plate 32 so as to disengage with clamping plate 40 and locking keys 37 and 38, and engage with connection arm pins 30 and 31 which are received in connection arm pin recesses 78.

Since locking plate 32 is fixedly connected to eccentric sleeve 20, sleeve 20 also moves axially outward, consequently forcing piston-like sleeve 54 axially outward. At this point, the eccentric sleeve 20 and locking plate 32 are fixedly locked to the connection arm 22 by means of the connection arm pins 30 and 31 received in recesses 78.

Once this is accomplished, referring to FIG. 3, the crankshaft 16 is rotated through the desired angle while the eccentric sleeve 20 and locking plate 32 are held nonrotatable on connection arm 22. By rotating eccentric portion 18 of the crankshaft 16 relative to eccentric sleeve 20, the overall resultant eccentricity of the system is changed. Since the stroke length is dependent upon the additive relative eccentricities of eccentric sleeve 20 and crankshaft eccentric portion 18, by rotating the crankshaft eccentric portion 18 relative to the eccentric sleeve 20, the stroke length is changed. Once the eccentric sleeve 20 and locking plate 32 are fixed to the connection arm 22, the inching cycle of the press is utilized to slowly rotate the crankshaft 16 to the desired position by discrete steps.

After the crankshaft 16 rotation is complete, hydraulic cylinders 70 and 71 are deactivated, disengaging pushers 72 and 73 from locking plate 32. In order to relock the mechanism, pressurized oil is fed into axial oil passage 62 to oil cavity 56 via first radial oil passage 64. The fluid pressure in oil cavity 56 creates a horizontal force moving piston-like sleeve 54 axially inward, urging against eccentric sleeve 20 and locking plate 32.

Locking plate 32 thereby disengages from connection arm pins 30 and 31 to again engage and lock with clamping plate locking keys 37 and 38. The eccentric sleeve 20 and locking plate 32 are now locked onto crankshaft 16 and will rotate therewith.

When limited to two stroke lengths, such adjustment will not create any phase change, that is, the top of the stroke will occur when the crankshaft is at 0° for both the long and short stroke lengths.

Although the preferred embodiment comprises a sliding plate to lock and unlock the eccentric relative to the connection arm, other mechanisms are also possible.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A process for adjusting the stroke length of a punch press, the punch press including a crankshaft with an eccentric portion, an eccentric sleeve radially disposed on the eccentric portion and selectively rotatable relative to the eccentric portion, a connection arm radially and rotatably disposed on the eccentric sleeve, a locking plate axially moveable on the crankshaft, a clamping plate fixed to the crankshaft, and a piston for receiving pressurized hydraulic fluid and thereby axially urging the locking plate into frictional engagement with the clamping plate during normal press operation, said process comprising the steps of:

relieving the hydraulic pressure in the piston and thereby disengaging the locking and clamping plates;

locking the eccentric sleeve to the connection arm;

then rotating the crankshaft through a desired angle;

then unlocking the eccentric sleeve from the connection arm; and then supplying pressurized hydraulic fluid to the piston to create frictional engagement between the locking and clamping plates for normal operation of the punch press.

2. The process of claim 1 wherein said rotating step includes utilizing the inching cycle of the press to rotate the crankshaft the desired angle by discrete steps.

3. The process of claim 1 wherein said locking step includes pressing the locking plate into engagement with the connection arm by a hydraulic pusher.

4. The process of claim 3 wherein said unlocking step includes deactivating the hydraulic pusher and thereby disengaging the locking plate and the connection arm.

* * * * *